United States Patent [19]

Noel et al.

[11] Patent Number: 4,547,135

[45] Date of Patent: Oct. 15, 1985

[54] MOTOR-PUMP UNIT

[75] Inventors: Alois Noel; Josef Zeitvogel; Erhard Wunderlich, all of Radolfzell; Michael Meichsner, Moos, all of Fed. Rep. of Germany

[73] Assignee: ALLWEILER AG Aktiengesellschaft, Radolfzell, Fed. Rep. of Germany

[21] Appl. No.: 558,919

[22] Filed: Dec. 7, 1983

[30] Foreign Application Priority Data

Dec. 11, 1982 [DE] Fed. Rep. of Germany ..... 3245973

[51] Int. Cl.[4] ..... F04B 39/06; F04C 1/10

[52] U.S. Cl. ..... 417/360; 417/366; 417/372; 418/197; 418/203

[58] Field of Search ..... 417/360, 366, 372, 410, 417/369, 365; 418/203, 197, 201

[56] References Cited

U.S. PATENT DOCUMENTS

| | | | |
|---|---|---|---|
| 2,640,430 | 6/1953 | Sennet | 418/197 |
| 2,809,590 | 10/1957 | Brown | 417/365 |
| 2,939,399 | 6/1960 | Rutschi | 417/370 |
| 3,558,248 | 1/1971 | Parker | 418/201 |
| 3,790,309 | 2/1974 | Volz | 417/410 |
| 4,028,025 | 6/1977 | Lonnebring | 418/203 |
| 4,242,067 | 12/1980 | Segerström | 418/203 |

FOREIGN PATENT DOCUMENTS

| | | | |
|---|---|---|---|
| 574657 | 3/1958 | Italy | 417/372 |

*Primary Examiner*—Cornelius J. Husar
*Assistant Examiner*—Peter M. Cuomo
*Attorney, Agent, or Firm*—Norman Lettvin

[57] ABSTRACT

A motor-pump unit consists of a screw shaft pump and a slot-barrel motor located on the pressure side of the pump. The motor-pump unit is provided with a rigid, preferably one-piece, shaft by which the motor drives the pump. The motor is located on the pressure chamber of the pump with a bearing between the motor and pump. The shaft is supported within the pump, in part by the bearing, and the rotor of the motor is cantilevered on the free end of the shaft outside the pressure chamber. The pot-shaped stator part of the motor is telescoped over the rotor and fastened directly to the pressure side of the pump.

7 Claims, 1 Drawing Figure

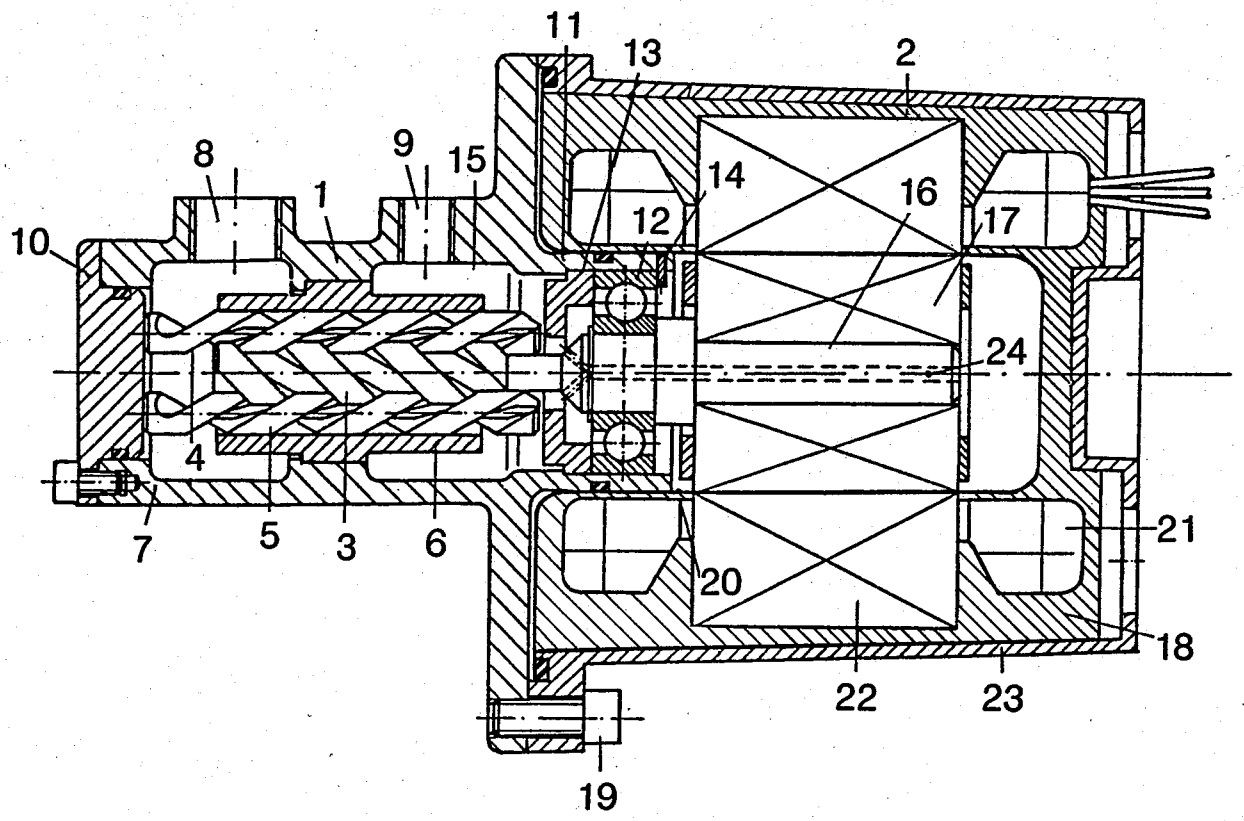
2
16
17
24
21
18
23
22
14
20
13
12
11
19
15
9
6
1
3
5
8
4
7
10

MOTOR-PUMP UNIT

BACKGROUND OF THE INVENTION

This invention relates to a motor-pump unit consisting of a screw-spindle pump and having located, on the pump's pressure side, a slot-barrel motor with a rigid, preferably one-piece, motor pump shaft. In a known motor-pump unit of this type, the slot-barrel motor is connected, to the drive spindle of the screw-spindle pump with a pressure side throttle interval interposed. The shaft end of the slot-barrel motor lying spaced from the screw-spindle pump is supported within the envelope of the slot-barrel motor. Furthermore, the common drive shaft of the slot-barrel motor and screw-spindle pump is longitudinally bored through in order to relieve the interior of the slot-barrel motor from the delivery pressure of the pump. This design is highly practical for relatively large motor-pump units, but it is very expensive in the case of smaller dimensions, where the delivery pressure and also the axial thrust at the screw-spindle pump are better controllable by the structure.

SUMMARY OF THE INVENTION

Underlying the present invention, therefore, is the problem of reducing the construction expenditure for the foregoing motor-pump unit shaft arrangement mentioned at the outset, especially in the case of relatively small dimensions.

For the solution of this problem it is proposed according to the invention that the slot-barrel motor be connected to the pressure chamber of the pump and surround a part of the pressure chamber, the motor pump shaft being supported between the pump part and the motor part, the rotor of the slot-barrel motor being cantilevered on the free shaft end outside of the bearing and the stator part of the slot-barrel motor being placed in the manner of a pot over the rotor and being fastened to the pump.

Advantageous developments of the invention follow from the description and claims below.

BRIEF DESCRIPTION OF THE DRAWING

FIG. 1 illustrates an example of a design of a motor-pump unit according to the present invention.

DETAILED DESCRIPTION OF A PREFERRED EMBODIMENT

A motor-pump unit is formed essentially by the screw-spindle pump 1 and the slot-barrel motor 2. In the screw-spindle pump the spindle package formed of drive shaft 3 and running spindles 4 and 5 is surrounded by a flow housing 6. The flow housing 6 is secured in the pump casing 7 proper, which has a connection for the suction line 8 and a connection for the pressure line 9 and is closed with a closure cover 10 on the suction side. On the pressure side the pump casing is provided with a neck 11, which centers on its inside diameter the bearing—a ball bearing 12 is represented—of the drive shaft as well as a spacer disk 13. The bearing and the spacer disk are fixed axially, on the one hand, by a ring collar on the pump casing, and on the other hand, by the tensioning sleeve 14 mounted in the pump casing. The spacing sleeve 13 limits the axial movability of the running spindles 4 and 5 toward the pressure side 15. The drive shaft 3 is extended beyond the ball bearing 12 and forms here the motor shaft 16 in which it holds cantilevered the rotor 17 of the slot-barrel motor 2. Through the fact that the drive shaft 3 is already twice supported in the flow housing 6 and in the ball bearing 12, a further bearing in the slot-barrel motor is no longer needed. The stator part 18 of the slot-barrel motor is, in the manner of a pot, telescoped over the rotor 17 and fastened to the screw-spindle pump 1 by means of the screws 19. The stator part 18 is centered with the barrel slot 20 on the outer diameter of the neck 11 of the pump casing. For reasons of stability, the hollow spaces in the stator part 18 between the barrel slot 20, the windings 21, and iron core 22 and the casing wall 23 are filled with a suitable casting resin. The stator thereby becomes very stable, so that it can be arranged without more ado, as here represented, on the pressure side of the pump. By filling with resin, further, the heat conductivity is increased, whereby the heat created in the windings is safely conducted away. The longitudinal bore 24 in the motor shaft part brings about prompt ventilation of the slot-barrel motor; furthermore, in consequence of the longitudinal bore a lubricating circulation can be developed in the slot-barrel motor.

The ball bearing 12 has a relatively large outside diameter. This is greater than the maximum radial interior dimension of the spindle package of the screw-spindle pump, which results from the external spacing of the running spindles 4 and 5. As a result of this step, or feature, and of the pot-type form of the stator part of the slot-barrel motor, a very simple construction and an orderly set-up, or assembly, from a single side results. After removal of the stator part 18 of the slot-barrel motor, the essential parts of the screw-spindle pump can be removed, without it being necessary to remove the pump casing 7 from the tube line.

What is claimed is:

1. in an assemblage of a screw-type pump and attached electric motor for driving the pump, the pump being of the screw-spindle type having axially elongated casing means apertured for connection to both a suction line and a high-pressure discharge line spaced axially of each other, and the motor including a rotor and stator, and being spaced axially of the pump:

the improvement comprising, in combination:

the pump casing means being shaped and arranged and axially extended, beyond the screw-spindle drive for the pump, in the direction toward the electric motor, to provide an elongated annular tubular neck;

an annular roller bearing positioned within the tubular neck;

an annular spacing sleeve positioned within said neck and engaging said bearing to aid in locating the bearing within the neck;

an elongated drive shaft, for both the screw-spindle pump and the motor, being of a length to cooperate with the screw-spindle pump and to extend through said roller bearing and into the motor portion of the assemblage;

the spacing sleeve being of a size that is operative to limit axial motion of the spindles of the screw-spindle pump toward the bearing;

a portion of the drive shaft, that extends away from the pump and past the bearing, having the rotor of the electric motor cantilever mounted thereon, and rotatable with the shaft;

the stator of the motor being pot shaped and being surrounded by an exterior casing wall, the pot shape of the stator providing for telescopic sliding of the motor stator over the motor's rotor to effect assembly of the motor and the pump; and means for effecting fastening of the motor's pot-shaped stator to the housing of the pump.

2. A construction as in claim 1 including a tensioning sleeve carried by the motor's stator, and being positioned for engaging and holding the bearing axially within the tubular neck and against the spacing sleeve.

3. A construction as in claim 1 wherein means are provided for engaging opposite axial ends of the outer race of the roller bearing for maintaining said roller bearing in position within the tubular neck.

4. A construction as in claim 1 wherein said portion of the drive shaft, that extends away from the motor and past the bearing has an axially extending bore therethrough, which vents liquid from the interior of the pump casing into the interior of the motor's stator.

5. A construction as in claim 1 wherein the bearing is positioned within and supported by the tubular neck, and the stator of the motor is positioned about and supported on the tubular neck.

6. A construction as in claim 1 wherein the outside diameter of the roller bearing is greater in diameter than the exterior dimension of the spindle portion of the screw-spindle pump.

7. A construction as in claim 1 wherein the motor's stator has hollow spaces provided therein that are filled with a synthetic resin that functions to receive and dissipate heat from the stator.

* * * * *